US009155408B2

(12) United States Patent
Alletto, Jr.

(10) Patent No.: US 9,155,408 B2
(45) Date of Patent: Oct. 13, 2015

(54) PILLOW PROTECTOR

(71) Applicant: BEDGEAR, LLC, Farmingdale, NY (US)

(72) Inventor: Eugene Alletto, Jr., Glen Head, NY (US)

(73) Assignee: BEDGEAR, LLC, Farmingdale, NY (US)

( * ) Notice: Subject to any disclaimer, the term of this patent is extended or adjusted under 35 U.S.C. 154(b) by 0 days.

(21) Appl. No.: 14/152,662

(22) Filed: Jan. 10, 2014

(65) Prior Publication Data

US 2014/0189955 A1 Jul. 10, 2014

Related U.S. Application Data

(60) Provisional application No. 61/751,004, filed on Jan. 10, 2013.

(51) Int. Cl.

| | |
|---|---|
| ***A47C 20/00*** | (2006.01) |
| ***A47G 9/02*** | (2006.01) |
| ***A47G 9/10*** | (2006.01) |
| *A47G 9/00* | (2006.01) |

(52) U.S. Cl.

CPC ..... *A47G 9/0253* (2013.01); *A47G 9/10* (2013.01); *A47G 9/1027* (2013.01); *A47G 9/1036* (2013.01); *A47G 2009/001* (2013.01)

(58) Field of Classification Search

CPC ..... A47G 9/10; A47G 9/1054; A47G 9/00; A47G 2009/001; A47G 9/0215; A47G 9/0253; A47G 9/0261; A47G 9/1027; A47G 9/1036

USPC ..... 5/638, 636, 490, 488, 482, 486, 489, 5/502, 421

See application file for complete search history.

(56) References Cited

U.S. PATENT DOCUMENTS

| | | | | |
|---|---|---|---|---|
| 6,408,468 | B1 * | 6/2002 | Comfort | 5/636 |
| 7,588,291 | B2 * | 9/2009 | Gold et al. | 297/219.12 |
| 8,307,480 | B2 * | 11/2012 | Tirpan | 5/699 |
| D672,183 | S * | 12/2012 | Alletto, Jr. | D6/601 |
| D672,184 | S * | 12/2012 | Alletto, Jr. | D6/601 |
| D672,186 | S * | 12/2012 | Alletto, Jr. | D6/606 |
| 8,646,134 | B1 * | 2/2014 | Alletto, Jr. | 5/636 |
| 8,726,435 | B2 * | 5/2014 | Briody | 5/632 |
| 2008/0244832 | A1 * | 10/2008 | Kuo | 5/638 |
| 2009/0083908 | A1 * | 4/2009 | Fry | 5/636 |
| 2010/0180381 | A1 * | 7/2010 | Verde Sanchez et al. | 5/636 |
| 2010/0319126 | A1 * | 12/2010 | Craib | 5/490 |
| 2012/0060280 | A1 * | 3/2012 | Kelly et al. | 5/490 |
| 2012/0278992 | A1 * | 11/2012 | Ou | 5/638 |

* cited by examiner

*Primary Examiner* — Peter M Cuomo
*Assistant Examiner* — David E Sosnowski
(74) *Attorney, Agent, or Firm* — Sorell, Lenna & Schmidt, LLP

(57) ABSTRACT

A pillow cover is provided that includes a first panel and a second panel perimetrically joined with the first panel such that inner surfaces of the first and second panels define a cavity having a void volume. The first and second panels are each made from a first material. An opening extends through the inner surface of the first panel and an outer surface of the first panel. The pillow cover includes a patch covering the opening. The patch is made from a second material that is different than the first material.

17 Claims, 4 Drawing Sheets

PILLOW PROTECTOR

REFERENCE TO RELATED APPLICATIONS

This application claims the benefit of U.S. Application Ser. No. 61/751,004, filed Jan. 10, 2013, which is incorporated herein by reference, in its entirety.

TECHNICAL FIELD

The present disclosure generally relates to bedding, and more particularly to pillow protectors configured to prevent contamination of pillows disposed within the pillow protectors and to provide proper air flow around the pillows.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that suit both their personal sleep preference and body type in order to achieve comfortable, restful sleep.

Pillows have been developed to suit various sleep preferences and body types by, for example, providing support to certain portions of a person's anatomy, such as, for example, the person's spine. Such pillows are typically covered using a conventional pillowcase, which is essentially a bag that is formed out of fabric or other material into which a pillow may be disposed. However, conventional pillowcases do not prevent dirt and oil, for example, from moving through the pillowcase and contaminating the pillow. Furthermore, conventional pillowcases do not allow air to escape, which leads to the buildup of heat within the pillowcase, causing discomfort. This disclosure describes an improvement over these prior art technologies.

SUMMARY

In one embodiment, in accordance with the principles of the present disclosure, a pillow protector is provided. The pillow protector comprises a first panel and a second panel perimetrically joined with the first panel such that inner surfaces of the first and second panels define a cavity having a void volume. The first and second panels are each made from a first material. An opening extends through the inner surface of the first panel and an outer surface of the first panel. The pillow cover comprises a patch covering the opening. The patch is made from a second material that is different than the first material.

In one embodiment, in accordance with the principles of the present disclosure, a bedding system is provided comprising a pillow cover. The pillow cover comprises a first panel and a second panel perimetrically joined with the first panel such that inner surfaces of the first and second panels define a cavity having a void volume. The first and second panels are each made from a first material. An opening extends through the inner surface of the first panel and an outer surface of the first panel. The pillow cover comprises a patch covering the opening. The patch is made from a second material that is different than the first material, the second material being more porous than the first material. The bedding system comprises a pillow disposed in the cavity.

In one embodiment, in accordance with the principles of the present disclosure, a bedding system is provided comprising a pillow cover. The pillow cover comprises a first panel and a second panel perimetrically joined with the first panel such that inner surfaces of the first and second panels define a cavity having a void volume. The first and second panels are each made from a first material. An opening extends through the inner surface of the first panel and an outer surface of the first panel. The pillow cover comprises a patch covering the opening. The patch is made from a second material that is different than the first material, the second material being more porous than the first material. The bedding system comprises a pillow disposed in the cavity. The bedding system comprises a pillowcase having the pillow cover disposed therein.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION

Figure 1:
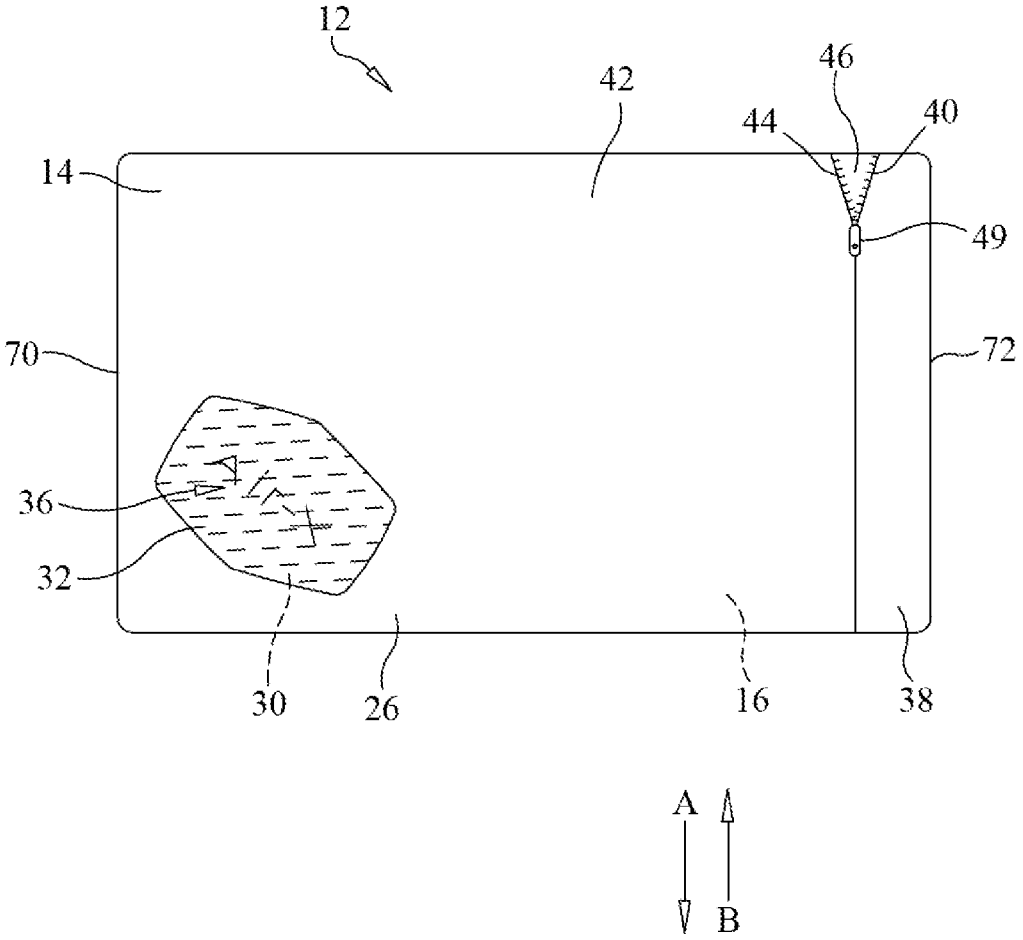
FIG. 1 is a top view of one embodiment of a pillow cover or protector in accordance with the principles of the present disclosure.
Figure 2:
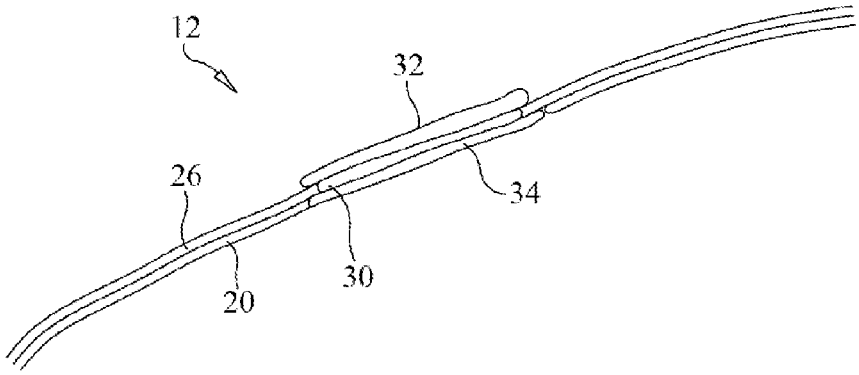
FIG. 2 is a side, cross-sectional view of a portion of the pillow cover shown in FIG. 1.
Figure 3:
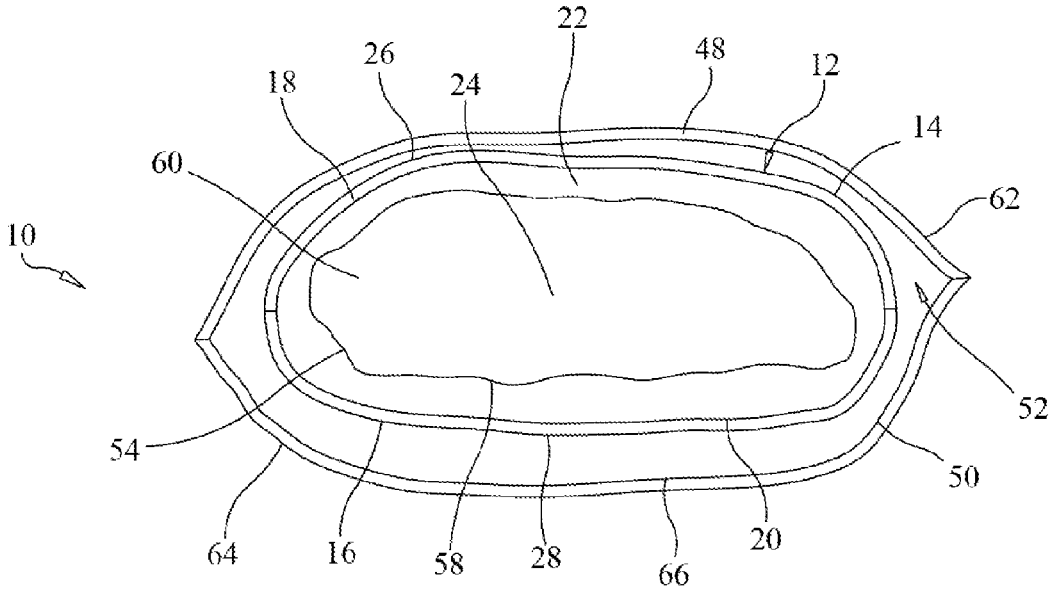
FIG. 3 is a side, cross-sectional view of a bedding system in accordance with the principles of the present disclosure.

The present disclosure may be understood more readily by reference to the following detailed description of the disclosure taken in connection with the accompanying drawing figures, which form a part of this disclosure. It is to be understood that this disclosure is not limited to the specific devices, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of a pillow cover in accordance with the principles of the present disclosure. Alternate embodiments are also disclosed. Reference will now be made in detail to the exemplary embodiments of the present disclosure, which are illustrated in the accompanying figures. Turning to FIGS. 1-5, there are illustrated components of a bedding system 10.

The system 10 including pillow cover 12 comprising a first panel 14 and a second panel 16 perimetrically joined with first panel 14 such that inner surfaces 18, 20 of first and second panels 14, 16 define a cavity 22 having a void volume configured for disposal of a pillow, such as, for example, pillow 24 of system 10. First and second panels 14, 16 each have a rectangular cross-sectional configuration such that cavity 22 has a size and shape that conforms to that of a standard size pillow. In some embodiments, first panel 14, second panel 16 and/or cavity 22 may have various cross section configurations, such as, for example, oval, oblong, triangular, rectangular, square, polygonal, irregular, uniform, non-uniform, variable, tubular and/or tapered. In some embodiments, inner surface 18 is continuous with inner surface 20 such that cavity 22 is completely enclosed by first and second panels 14, 16.

At least one of first and second panels 14, 16 is made from a first material, such as, for example, a breathable fabric. In some embodiments, at least one of first and second panels 14, 16 is made from a compliant fabric. In some embodiments, at least one of first and second panels 14, 16 is made from a moisture-wicking fabric, such as, for example, single layer 100% polyester fiberfill fabric, multi-layer (e.g. triple layer) 100% polyester fiberfill fabric, a polyester fabric, 100% polyester fabric, rayon, nylon, 3D spacer fabric, cotton-polyester blend fabric or spandex-blend fabric. In some embodiments, at least one of first and second panels 14, 16 is made from an elastic material, such as, for example, a polyester/spandex blend of knit fabric to provide maximum stretch for conforming fit and heat and moisture-wicking. In some embodiments, at least one of first and second panels 14, 16 is made from 100% polyester knit, 100% natural fabrics, natural fibers (cotton blended with elastic fibers), or man-made materials. In some embodiments, at least one of first and second panels 14, 16 is made from a fabric that is not moisture repellant. In some embodiments, at least one of first and second panels 14, 16 is made from a moisture dispersing material. In some embodiments, at least one of first and second panels 14, 16 is made from a nonwoven material. In some embodiments, at least one of first and second panels 14, 16 is made from a fabric that does not have an open cell construction. In some embodiments, the term "open cell construction" refers to a construction having an overall porosity that is greater than an inherent porosity of the constituent material or inherently having high porosity.

In some embodiments, at least one of first and second panels 14, 16 comprises a single layer of fabric. In some embodiments, at least one of first and second panels 14, 16 comprises multiple layers of fabric. In some embodiments, inner surface 18 defines a first layer of panel 14 and an outer surface 26 of panel 14 defines a second layer of panel 14. In some embodiments, the first layer comprises a moisture repellant material and the second layer comprises at least one of the first materials discussed in the preceding paragraph. In some embodiments, the first layer comprises a breathable material. In some embodiments, the first layer comprises a non-breathable material. In some embodiments, the first layer comprises a laminated material and the second layer comprises a breathable material. In some embodiments, the first layer comprises a layer of gel, such as, for example, a cooling gel.

In some embodiments, inner surface 20 defines a first layer of panel 16 and an outer surface 28 of panel 16 defines a second layer of panel 16. In some embodiments, the first layer of panel 16 comprises a moisture repellant material and the second layer of panel 16 comprises at least one of the materials discussed in the preceding paragraph. In some embodiments, the first layer of panel 16 comprises a breathable material. In some embodiments, the first layer of panel 16 comprises a non-breathable material. In some embodiments, the first layers of panels 14, 16 are continuous such that the first layers of panels 14, 16 define cavity 22. In some embodiments, the first layer of panel 16 comprises a laminated material and the second layer of panel 16 comprises a breathable material. In some embodiments, the first layer of panel 16 comprises a layer of gel, such as, for example, a cooling gel.

An opening 30 extends through surfaces 18, 26 of first panel 14 and provides a pathway for air, for example, to enter and exit cavity 22. As such, it is envisioned that heat that builds up within cavity 22 may be released through opening 30. Likewise, ambient air may be introduced into cavity 22 through opening 30. In some embodiments, opening 30 may have various cross section configurations, such as, for example, oval, oblong, triangular, rectangular, square, polygonal, irregular, uniform, non-uniform, variable, tubular and/or tapered. In one embodiment, opening 30 comprises more than one half of the area of panel 14. In one embodiment, opening 30 comprises one half of the area of panel 14. In one embodiment, opening 30 comprises less than one half of the area of panel 14. In one embodiment, opening 30 comprises less than one quarter of the area of panel 14. In one embodiment, opening 30 comprises less than one eighth of the area of panel 14.

Opening 30 is covered by a patch 32 that engages surface 26 of panel 14. Patch 32 can be a mono-layer fabric or a multi-layer fabric, for example, a multi-layer mesh having fibers running there through wherein the mesh is designed to allow for the transfer or passing of air. In some embodiments the patch is a 3-dimentional spacer mesh made from a knit fabric with porosity. In some embodiments, patch 32 has an area that is greater than that of opening 30 and is positioned relative to opening 30 such that patch 32 completely covers opening 30. Patch 32 is made from a second material that is different from the first material from which panels 14, 16 are made. In some embodiments, patch 32 is made from a material that is more breathable than a material from which first and second panels 14, 16 are made. In some embodiments, patch 32 is made from a material that is more porous than a material from which first and second panels 14, 16 are made. In some embodiments, patch 32 is made from a material having an open cell construction to permit air to flow in and out of opening 30 through patch 32. As such, patch 32 acts as a filter that can prevent solid particles from entering cavity 22 while simultaneously allowing air within cavity 22 to escape through opening 30. In some embodiments, patch 32 includes indicia 36 that provides information relating to pillow cover 12. In some embodiments, patch 32 is fixed to surface 26 of panel 14 using an adhesive. In some embodiments, patch 32 is fixed to surface 26 of panel 14 by stitching.

In some embodiments, pillow cover 12 includes a filter 34 that engages inner surface 18 such that opening 30 is positioned between patch 32 and filter 34. Filter 34 is made from a third material that is different from the first material from which panels 14, 16 are made. In some embodiments, the third material is different than the second material from which patch 32 is made. In some embodiments, the third material is the same as the second material from which patch 32 is made. In some embodiments, filter 34 is made from a fabric. In some embodiments, filter 34 is made from a material that is more breathable than a material from which first and second panels 14, 16 are made. In some embodiments, filter 34 is made from a material that is more porous than a material from which first and second panels 14, 16 are made. In some embodiments, filter 34 is made from a material having an open cell construction to permit air to flow in and out of opening 30 through filter 34 and patch 32. In some embodiments, filter 34 is made from a material that is more porous than a material from which first and second panels 14, 16 are made, but less porous than the material from which patch 32 is made. In some embodiments, filter 34 is made from a material having an open cell construction to permit air to flow in and out of opening 30 through filter 34 and patch 32. As such, filter 34 acts as a second filter that can prevent solid particles from entering cavity 22. In some embodiments, filter 34 includes pores that alternate with pores of patch 32. In some embodiments, filter 34 includes pores that are aligned with pores of patch 32. In some embodiments, filter 34 has a cross-sectional configuration that is similar or substantially similar to that of patch 32 such that filter 34 is spanned by patch 32, and vice versa. In some embodiments, filter 34 is fixed to inner surface 18 using an adhesive. In some embodiments, filter 34 is fixed to inner surface 18 by stitching.

First panel 14 includes a first portion 38 having a first fastener, such as, for example, first row of teeth 40 and a second portion 42 that is separable from first portion 38 having a second fastener, such as, for example, a second row of teeth 44 configured to interdigitate with teeth 40 to join first portion 38 with second portion 42. Teeth, 40, 44 define a zipper that allows panel 14 to move between first configuration in which teeth 40, 44 are spaced apart from one another to define an opening 46 between portions 38, 42 and a second configuration in which teeth 40, 44 engage one another to close opening 46. Panel 14 may be moved between the first and second configurations by moving a slider 49 of the zipper in a direction shown by arrow A or a direction shown by arrow B. In some embodiments, portion 38 or portion 42 is configured to overlap at least a portion of the other of portion 38 and portion 42 such that portion 38 or portion 42 define a flap that covers teeth 40, 44. In some embodiments, panels 14, 16 include snaps, buttons, strings, hook-and-pile fasteners to move panel 14 between open and closed configurations. In one embodiment, opening 30, patch 32 and filter 34 are positioned adjacent a first side 70 of pillow cover 12 and the zipper is positioned on an opposite second side 72 of pillow cover 12. In one embodiment, opening 30, patch 32 and filter 34 are positioned in second portion 38, adjacent second side 72.

In one embodiment, panel 14 is moved from the second configuration to the first configuration to separate first portion 38 from second portion 42. Pillow 24 is inserted into cavity 22 such that an outer surface of pillow 24 engages surfaces 18, 20. In some embodiments, pillow 24 includes a cover 54 having a first panel 56. A fill material 60 is disposed in a cavity defined by an inner surface panel 56. In some embodiments, fill material 60 comprises a compliant material. In some embodiments, fill material 60 comprises a cushioning material such as, for example, polyester fiber, wool, kapok and other fibers, latex foam pieces, memory foam pieces, feathers, man-made materials and blends thereof. In some embodiments, panel 56 is made from an elastic material such as, for example, a polyester/spandex blend of knit fabric, in order to provide maximum stretch for conforming fit and heat and moisture-wicking. In some embodiments, panel 56, is made from a material comprising 100% polyester knit, 100% natural fabrics, natural fibers e.g. cotton blended with elastic fibers, waterproof fabrications or man-made materials can be used.

By disposing pillow 24 in pillow cover 12, pillow cover 12 acts as a barrier to prevent staining of pillow 24 by perspiration, oil, etc. Pillow cover 12 also acts to allow air surrounding pillow 24 to escape through opening 30. This configuration allows heat that may build up in cavity 22 to escape cavity 22 through opening 30. Likewise, opening 30 allows ambient air to enter cavity 22 to cool cavity 22. Because pillow 24 is disposed in cavity 22, cooling cavity 22 will also cool pillow 24 to provide a more comfortable sleep surface, as would be apparent to one of ordinary skill in the art. Pillow 24 may be removed from pillow cover 12 by moving panel 14 from the second configuration to the first configuration and withdrawing pillow through opening 46.

In one embodiment, system 10 includes a pillowcase 48 having a first panel 62 and a second panel 64 perimetrically bounding, and joining second first panel 62. Pillowcase 48 includes an inner surface 66 defining a cavity 68. In one embodiment, pillow cover 12 is disposed in cavity 68 such that surfaces 26, 28 engage surface 66. By disposing pillow cover 12 in pillowcase 48, pillowcase 48 acts as a barrier to prevent staining of pillow cover 12 by perspiration, oil, etc.

Figure 4:
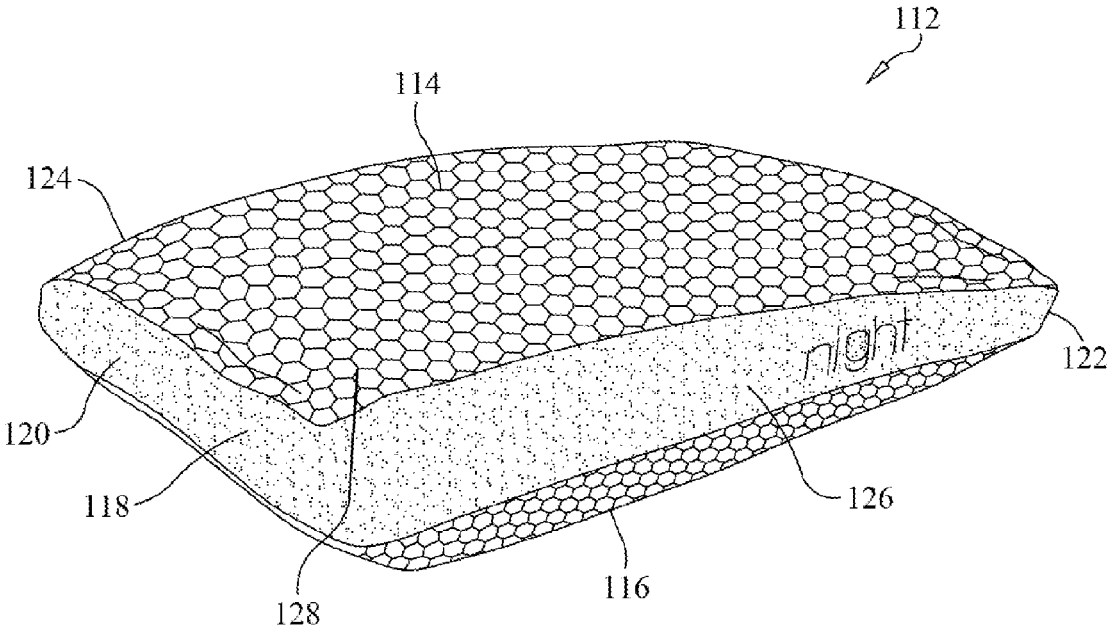
FIG. 4 is a perspective view of one embodiment of a pillow cover or protector in accordance with the principles of the present disclosure.

In one embodiment, shown in FIG. 4, system 10 includes a pillow cover 112, similar to pillow cover 12 that includes opposing first and second panels 114, 116 and a gusset 118 perimetrically bounding, and joining first and second panels 114, 116. Inner surfaces of first and second panels 114, 116 define a cavity having a void volume configured for disposal of a pillow, such as, for example, pillow 24. First and second panels 114, 116 each have a rectangular cross-sectional configuration such that the cavity defined by the inner surfaces of first and second panels 114, 116 has a size and shape that conforms to that of a standard size pillow. In some embodiments, first panel 114 and/or second panel 116 may have various cross section configurations, such as, for example, oval, oblong, triangular, rectangular, square, polygonal, irregular, uniform, non-uniform, variable, tubular and/or tapered.

In some embodiments, at least one of first and second panels 114, 116 includes stitching 128 that reduces the profile of stitched portions of first and second panels 114, 116. In some embodiments, stitching 128 forms patterns into the fabric first and second panels 114, 116 to create different elevations of the fabric structure, so that there are highs and lows of profile that increase air circulation in and around as well as through first and second panels 114, 116 and between first and second panels 114, 116 and a sleeper. In some embodiments, stitching 54 comprises a plurality of rows each having a geometric pattern. In some embodiments, the rows alternate such that a feature of the geometric pattern in a respective row is not coaxial with the same feature of the geometric pattern of an adjacent row.

At least one of first and second panels 114, 116 is made from a first material, such as, for example, a breathable fabric. In some embodiments, at least one of first and second panels 114, 116 is made from a compliant fabric. In some embodiments, at least one of first and second panels 114, 116 is made from a moisture-wicking fabric, such as, for example, single layer 100% polyester fiberfill fabric, multi-layer (e.g. triple layer) 100% polyester fiberfill fabric, a polyester fabric, 100% polyester fabric, rayon, nylon or spandex-blend fabric. In some embodiments, at least one of first and second panels 114, 116 is made from an elastic material, such as, for example, a polyester/spandex blend of knit fabric to provide maximum stretch for conforming fit and heat and moisture-wicking. In some embodiments, at least one of first and second panels 114, 116 is made from 100% polyester knit, 100% natural fabrics, natural fibers (cotton blended with elastic fibers), or man-made materials. In some embodiments, at least one of first and second panels 114, 116 is made from a fabric that is not moisture repellant. In some embodiments, at least one of first and second panels 114, 116 is made from a moisture dispersing material. In some embodiments, at least one of first and second panels 114, 116 is made from a nonwoven material. In some embodiments, at least one of first and second panels 14, 16 is made from a fabric that does not have an open cell construction. In some embodiments, at least one of first and second panels 114, 116 is made from a fabric that does not have an open cell construction. In some embodiments, at least one of first and second panels 114, 116 comprises a single layer of fabric. In some embodiments, at least one of first and second panels 114, 116 comprises multiple layers of fabric.

In some embodiments, gusset 118 is formed of a second material that is different than the first material that forms first and second panels 114, 116. In some embodiments, gusset 118 is made from a material that is more breathable than a material from which first and second panels 114, 116 are made. In some embodiments, gusset 118 is made from a material that is more porous than a material from which first and second panels 114, 116 are made. In some embodiments, gusset 118 is made from a material having an open cell construction to permit air to flow in and out of the cavity defined by the inner surfaces of first and second panels 114, 116. As such, gusset 118 acts as a filter that can prevent solid particles from entering the cavity defined by the inner surfaces of first and second panels 114, 116, while simultaneously permitting air and/or heat that builds up within the cavity defined by the inner surfaces of first and second panels 114, 116 to escape.

Figure 5:
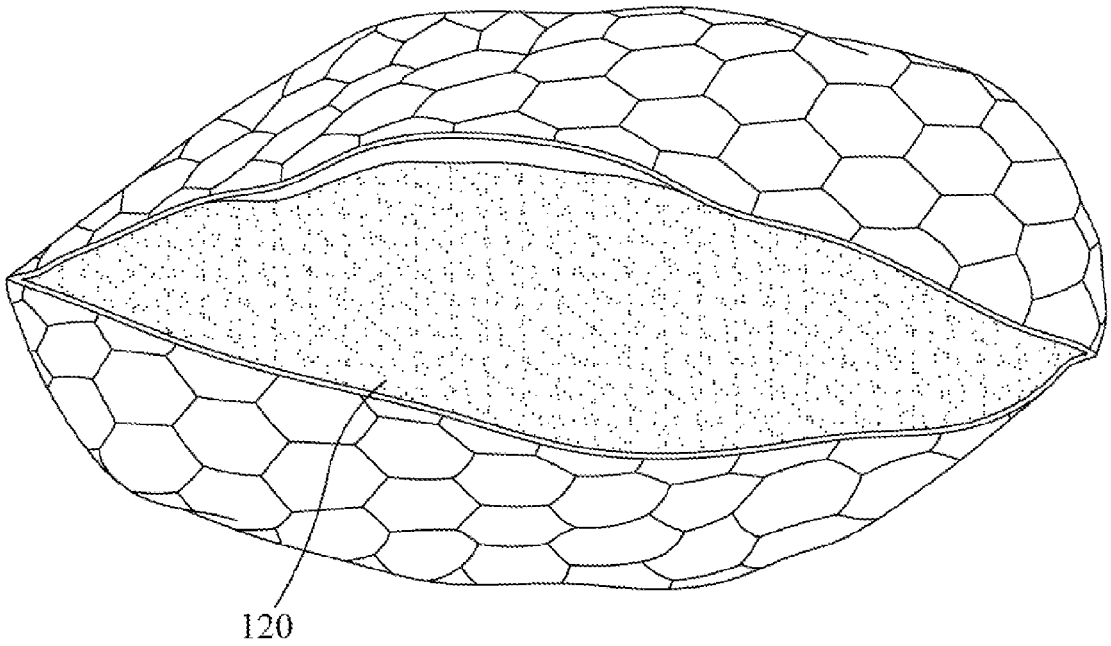
FIG. 5 is a perspective view of the pillow cover shown in FIG. 4.

In one embodiment, gusset 118 has a uniform construction such that gusset consists essentially of the second material. In some embodiments, the gusset 118 is on only one side of the pillow case. In other embodiments, the gusset 118 is on two sides of the pillowcase or in the alternative around the complete perimeter of the pillowcase. In some embodiments, gusset 118 is made from a material that is more breathable than a material from which first and second panels 114, 116 are made. In one embodiment, gusset 118 includes a first end 120, a second end 122 opposite first end 120 and opposite first and second sides 124, 126 extending between first and second ends 120, 122. In some embodiments, first and second sides 124, 126 are made from the first material that first and second panels 114, 116 are made from and at least one of first and second ends 120, 122 are made from a second material that is different than the first material that forms first and second panels 114, 116. In some embodiments, first and second sides 124, 126 are made from the first material that first and second panels 114, 116 are made from and first end 120 is made from a second material that is different than the first material that forms first and second panels 114, 116, as shown in FIG. 5. As also shown in FIG. 5, the breathable material may be on only one side of the pillowcase. In some embodiments, at least one of first and second ends 120, 122 is made from a material that is more porous than a material from which first and second panels 114, 116 are made. In some embodiments, at least one of first and second ends 120, 122 is made from a material having an open cell construction to permit air to flow in and out of the cavity defined by the inner surfaces of first and second panels 114, 116. As such, at least one of first and second ends 120, 122 acts as a filter that can prevent solid particles from entering the cavity defined by the inner surfaces of first and second panels 114, 116, while simultaneously permitting air and/or heat that builds up within the cavity defined by the inner surfaces of first and second panels 114, 116 to escape there through.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A pillow cover, comprising:

a first panel; and a second panel perimetrically joined with the first panel such that inner surfaces of the first and second panels define a cavity having a void volume, wherein the first and second panels are each made from a first material, wherein an opening extends through the inner surface of the first panel and an outer surface of the first panel, the opening having a size, shape and arrangement, the pillow cover comprising a patch covering the opening, the patch being made from a second material that is different than the first material, wherein the second panel is free of any openings having the size, shape and arrangement of the opening in the first panel; and wherein the pillow cover comprises a filter that engages an inner surface of the first panel such that the opening is positioned between the patch and the filter, the filter and the patch each having pores, wherein the pores of the filter alternate with the pores of the patch.

2. A pillow cover as recited in claim 1, wherein the first material is a triple layer 100% polyester fiberfill fabric.

3. A pillow cover as recited in claim 1, wherein the first material is selected from a group consisting of polyester, rayon, nylon and a spandex-blend fabric.

4. A pillow cover as recited in claim 1, wherein the second material has an open cell construction.

5. A pillow cover as recited in claim 1, wherein the second material is more porous than the first material.

6. A pillow cover as recited in claim 1, wherein the first and second panels each include a laminated first layer and a second layer comprising a breathable material, the first layers facing one another, the first layers being configured to engage one another when a pillow is not positioned in the cavity.

7. A pillow cover as recited in claim 1, wherein the first panel includes a first portion having a first fastener and a second portion that is separable from the first portion having a second fastener configured to engage the first fastener to join the first portion with the second portion.

8. A pillow cover as recited in claim 7, wherein the first fastener includes a first row of teeth and the second fastener includes a second row of teeth configured to interdigitate with the first row of teeth.

9. A pillow cover as recited in claim 1, wherein the first panel has an area defined by an amount of space within a perimeter of the first panel, the opening comprising more than one half of the area.

10. A pillow cover as recited in claim 1, wherein the pillow cover comprises a filter that engages an inner surface of the first panel, the filter comprises a third material that is different than the first material, the third material being more porous than the first material.

11. A pillow cover as recited in claim 10, wherein the third material is different than the second material.

12. A bedding system, comprising:

a pillow cover comprising:

a first panel, and a second panel perimetrically joined with the first panel such that inner surfaces of the first and second panels define a cavity having a void volume, the first and second panels each being made from a first material, wherein an opening extends through the inner surface of the first panel and an outer surface of the first panel, the opening having a size, shape and arrangement, the pillow cover comprising a patch covering the opening, the patch being made from a second material that is different than the first material, the second material being more porous than the first material;

a pillow disposed in the cavity, wherein the second panel is free of any openings having the size, shape and arrangement of the opening in the first panel; and wherein the pillow cover comprises a filter that engages an inner surface of the first panel such that the opening is positioned between the patch and the filter, the filter comprises a third material that is different than the first material, the third material being more porous than the first material.

13. A bedding system as recited in claim 12, wherein the pillow cover includes a filter that engages the inner surface of the first panel, the filter and the patch each having pores, wherein the pores of the filter alternate with the pores of the patch.

14. A bedding system as recited in claim 12, wherein the first and second panels each include a laminated first layer and a second layer comprising a breathable material, the first layers facing one another, the first layers being configured to engage one another when a pillow is not positioned in the cavity.

15. A bedding system as recited in claim 12, wherein the first panel includes a first portion having a first row of teeth and a second portion that is separable from the first portion having a second row of teeth configured to interdigitate with the first row of teeth to join the first portion with the second portion.

16. A bedding system, comprising:

a pillow cover comprising:

a first panel, and a second panel perimetrically joined with the first panel such that inner surfaces of the first and second panels define a cavity having a void volume, the first and second panels each being made from a first material, wherein an opening extends through the inner surface of the first panel and an outer surface of the first panel, the opening having a size, shape and arrangement, the pillow cover comprising a patch covering the opening, the patch being made from a second material that is different than the first material, the second material being more porous than the first material;

a pillow disposed in the cavity;

a pillowcase having the pillow cover disposed therein, wherein an area defined by a perimeter of the second panel is free of any openings having the size, shape and arrangement of the opening in the first panel; and wherein the pillow cover comprises a filter that engages an inner surface of the first panel such that the opening is positioned between the patch and the filter, the filter and the patch each having pores, and wherein the pores of the filter alternate with the pores of the patch.

17. A bedding system as recited in claim 16, wherein:

the first material is selected from a group consisting of polyester, rayon, nylon and a spandex-blend fabric;

the second material has an open cell construction;

the first and second panels each include a laminated first layer and a second layer comprising the first material, the first layers facing one another; and the first panel includes a first portion having a first row of teeth and a second portion that is separable from the first portion having a second row of teeth configured to interdigitate with the first row of teeth to join the first portion with the second portion.

* * * * *